US005879039A

United States Patent [19]

Baker et al.

[11] Patent Number: 5,879,039

[45] Date of Patent: Mar. 9, 1999

[54] BAG FILLING DEVICE

[76] Inventors: Charles A. Baker; Sandra Baker, both of 2522 Davis Rd. Box #644, Williams, Calif. 95987

[21] Appl. No.: 997,927

[22] Filed: Dec. 24, 1997

[51] Int. Cl.[6] ..... B65B 67/04

[52] U.S. Cl. ..... 294/55; 294/1.1; 141/108; 141/390

[58] Field of Search ..... 294/1.1, 1.4, 55; 141/108, 109, 313, 331, 390, 391; 15/104.8, 257.1, 257.3; 248/95, 99

[56] References Cited

U.S. PATENT DOCUMENTS

| | | | |
|---|---|---|---|
| 112,727 | 3/1871 | Lum | 141/390 |
| 571,513 | 11/1896 | Davidson | 294/55 |
| 1,167,782 | 1/1916 | Richards | 294/55 |
| 5,090,756 | 2/1992 | Pfisterer | 294/55 |
| 5,107,666 | 4/1992 | Rahtican | 294/55 |
| 5,498,046 | 3/1996 | Ridley, Sr. et al. | 294/55 |
| 5,655,739 | 8/1997 | Teh-Wah Goo | 141/391 |

*Primary Examiner*—Dean Kramer

[57] ABSTRACT

A new bag filling device for easily scooping ballast material, such as sand or dirt, into a flexible bag. The inventive device includes an elongate tubular body member formed by a perimeter wall having inner and outer surfaces with the inner surface defining a body member hollow interior. At the top end of the body member is a top edge defining an upper opening into the body member hollow interior. The top edge also includes a scooping portion which is positioned towards the back of the body member. The scooping portion is designed for permitting the scooping of material, such as sand, dirt, and gravel, through the upper opening into the body member hollow interior. The bottom end of the body member has a bottom edge which defines a lower opening into the body member hollow interior. The bottom end of the body member is designed for insertion through the opening and into the interior of a flexible bag to permit passage of material through the body member hollow interior into the interior of a flexible bag.

6 Claims, 2 Drawing Sheets

BAG FILLING DEVICE

BACKGROUND OF THE INVENTION

1. Field of the Invention

The present invention relates to bag filling devices and more particularly pertains to a new bag filling device for easily scooping ballast material, such as sand or dirt, into a flexible bag.

2. Description of the Prior Art

The use of bag filling devices is known in the prior art. More specifically, bag filling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art bag filling devices include U.S. Pat. No. 5,395,147; U.S. Pat. No. 4,149,745; U.S. Pat. No. 5,107,666; U.S. Pat. No. 4,700,978; U.S. Pat. No. Des. 321,631; and U.S. Pat. No. Des. 337,244.

While these devices fulfill their respective, particular objectives and requirements, the aforementioned patents do not disclose a new bag filling device. The inventive device includes an elongate tubular body member formed by a perimeter wall having inner and outer surfaces with the inner surface defining a body member hollow interior. At the top end of the body member is a top edge defining an upper opening into the body member hollow interior. The top edge also includes a scooping portion which is positioned towards the back of the body member. The scooping portion is designed for permitting the scooping of material, such as sand, dirt, and gravel, through the upper opening into the body member hollow interior. The bottom end of the body member has a bottom edge which defines a lower opening into the body member hollow interior. The bottom end of the body member is designed for insertion through the opening and into the interior of a flexible bag to permit passage of material through the body member hollow interior into the interior of a flexible bag.

In these respects, the bag filling device according to the present invention substantially departs from the conventional concepts and designs of the prior art, and in so doing provides an apparatus primarily developed for the purpose of easily scooping ballast material, such as sand or dirt, into a flexible bag.

SUMMARY OF THE INVENTION

In view of the foregoing disadvantages inherent in the known types of bag filling devices now present in the prior art, the present invention provides a new bag filling device construction wherein the same can be utilized for easily scooping ballast material, such as sand or dirt, into a flexible bag.

The general purpose of the present invention, which will be described subsequently in greater detail, is to provide a new bag filling device apparatus and method which has many of the advantages of the bag filling devices mentioned heretofore and many novel features that result in a new bag filling device which is not anticipated, rendered obvious, suggested, or even implied by any of the prior art bag filling devices, either alone or in any combination thereof.

To attain this, the present invention generally comprises an elongate tubular body member formed by a perimeter wall having inner and outer surfaces with the inner surface defining a body member hollow interior. At the top end of the body member is a top edge defining an upper opening into the body member hollow interior. The top edge also includes a scooping portion which is positioned towards the back of the body member. The scooping portion is designed for permitting the scooping of material, such as sand, dirt, and gravel, through the upper opening into the body member hollow interior. The bottom end of the body member has a bottom edge which defines a lower opening into the body member hollow interior. The bottom end of the body member is designed for insertion through the opening and into the interior of a flexible bag to permit passage of material through the body member hollow interior into the interior of a flexible bag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bag filling device apparatus and method which has many of the advantages of the bag filling devices mentioned heretofore and many novel features that result in a new bag filling device which is not anticipated, rendered obvious, suggested, or even implied by any of the prior art bag filling devices, either alone or in any combination thereof.

It is another object of the present invention to provide a new bag filling device which may be easily and efficiently manufactured and marketed.

It is a further object of the present invention to provide a new bag filling device which is of a durable and reliable construction.

An even further object of the present invention is to provide a new bag filling device which is susceptible of a low cost of manufacture with regard to both materials and labor, and which accordingly is then susceptible of low prices of sale to the consuming public, thereby making such bag filling device economically available to the buying public.

Still yet another object of the present invention is to provide a new bag filling device which provides in the apparatuses and methods of the prior art some of the advantages thereof, while simultaneously overcoming some of the disadvantages normally associated therewith.

Still another object of the present invention is to provide a new bag filling device for easily scooping ballast material, such as sand or dirt, into a flexible bag.

Yet another object of the present invention is to provide a new bag filling device which includes an elongate tubular body member formed by a perimeter wall having inner and outer surfaces with the inner surface defining a body member hollow interior. At the top end of the body member is a top edge defining an upper opening into the body member hollow interior. The top edge also includes a scooping portion which is positioned towards the back of the body member. The scooping portion is designed for permitting the scooping of material, such as sand, dirt, and gravel, through the upper opening into the body member hollow interior. The bottom end of the body member has a bottom edge which defines a lower opening into the body member hollow interior. The bottom end of the body member is designed for insertion through the opening and into the interior of a flexible bag to permit passage of material through the body member hollow interior into the interior of a flexible bag.

Still yet another object of the present invention is to provide a new bag filling device that permits the quick filling of flexible bags, such as a sandbag, in a single scoop rather than several time consuming shovelfulls.

Even still another object of the present invention is to provide a new bag filling device that greatly reduces the labor requirements needed to produce a large number of filled sandbags in an emergency situation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
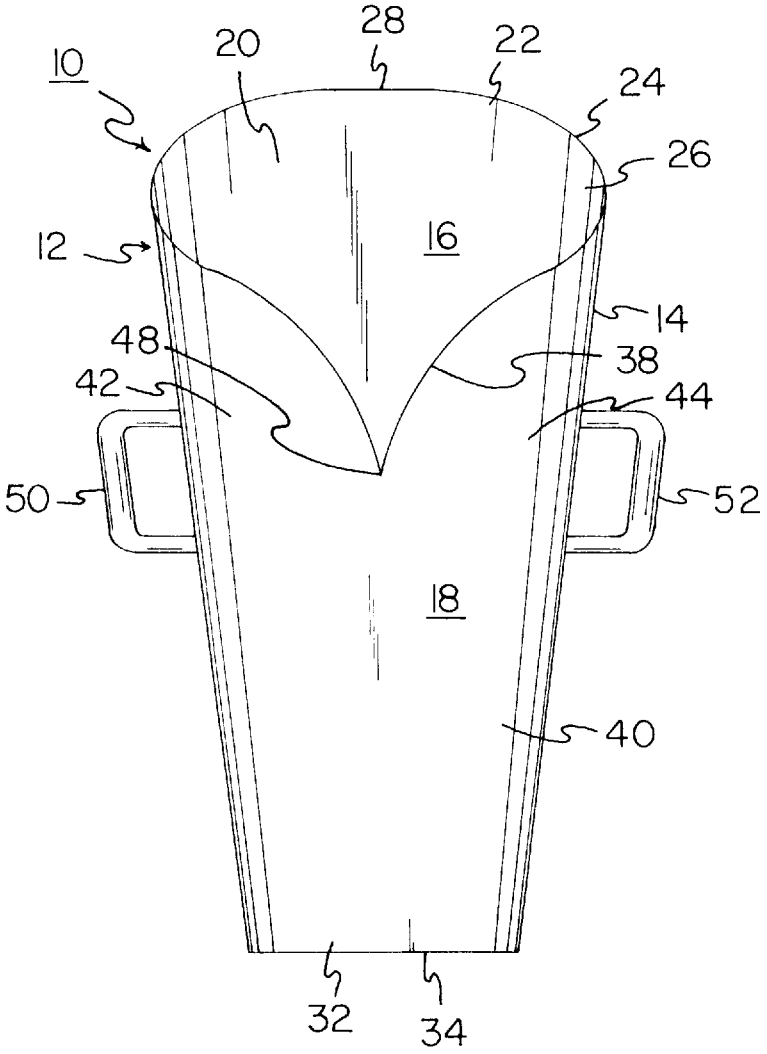
FIG. 1 is a schematic front side view of a new bag filling device according to the present invention.
Figure 2:
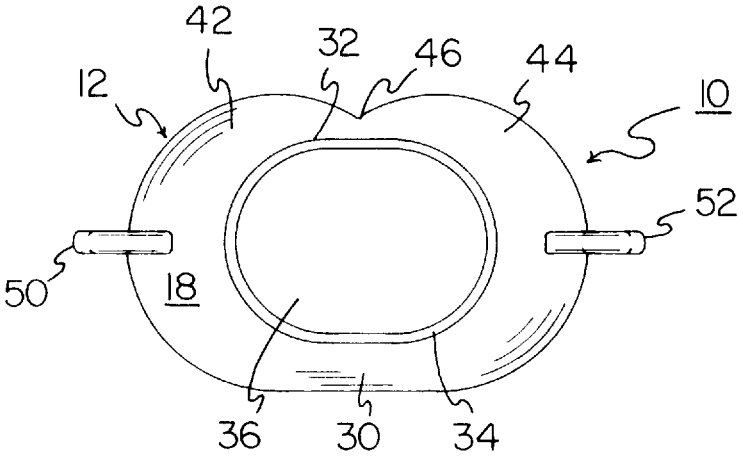
FIG. 2 is a schematic bottom side view of the present invention.
Figure 3:
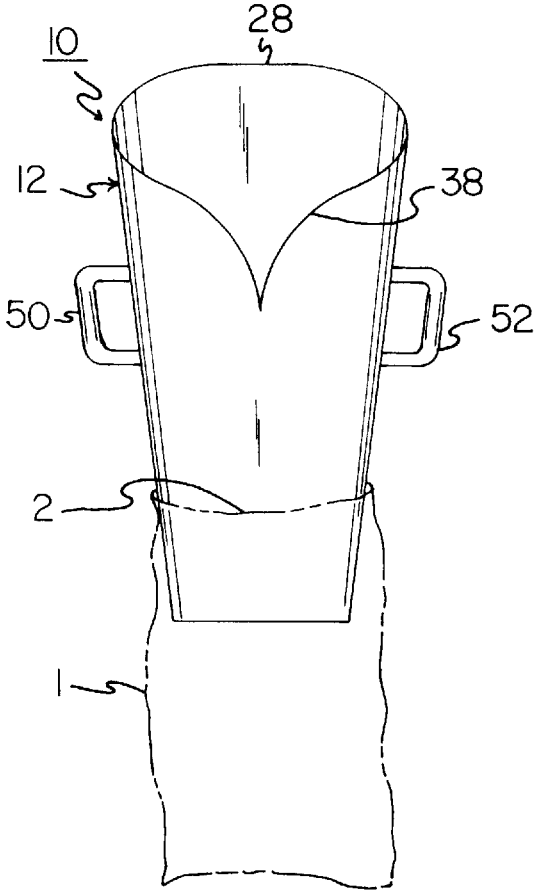
FIG. 3 is a schematic front side view of the present invention with the bottom end of the body member inserted into a flexible bag for filling of the bag with material.
Figure 4:
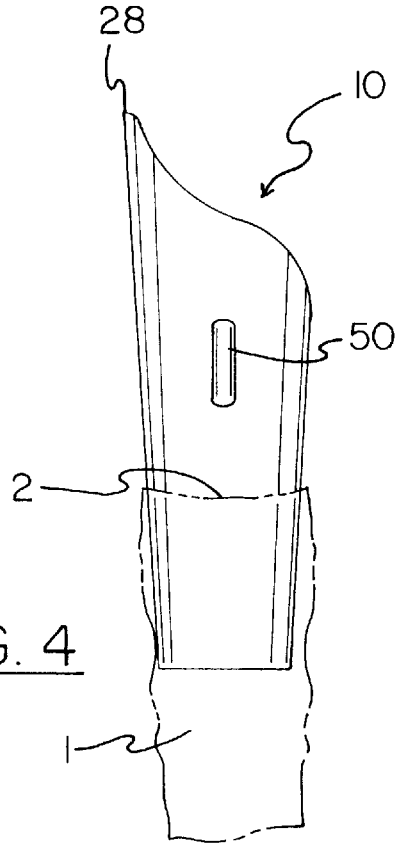
FIG. 4 is a schematic left side view of the present invention with the bottom end of the body member inserted into a flexible bag for filling of the bag with material.

With reference now to the drawings, and in particular to FIGS. 1 through 3 thereof, a new bag filling device embodying the principles and concepts of the present invention and generally designated by the reference numeral 10 will be described.

The bag filling device 10 is designed for filling a flexible bag 1, such as a sandbag, having an opening 2 into its interior. As best illustrated in FIGS. 1 through 3, the bag filling device 10 generally comprises an elongate tubular body member 12 formed by a perimeter wall 14 having inner and outer surfaces 16,18 with the inner surface defining a body member hollow interior 20. At the top end 22 of the body member 12 is a top edge 24 defining an upper opening 26 into the body member hollow interior 20. The top edge 24 also includes a scooping portion 28 which is positioned towards the back 30 of the body member 12. The scooping portion 28 is designed for permitting the scooping of material, such as sand, dirt, and gravel, through the upper opening 26 into the body member hollow interior 20. The bottom end 32 of the body member 12 has a bottom edge 34 which defines a lower opening 36 into the body member hollow interior 20. The bottom end 34 of the body member 12 is designed for insertion through the opening 2 and into the interior of a flexible bag 1 to permit passage of material through the body member hollow interior 20 into the interior of a flexible bag 1.

Preferably, the body member is tapered towards the bottom end so that the opening 2 of a flexible bag 1 can be extended along the outer surface 18 of the perimeter wall 14 towards the top end 22 of the body member 12 to help hold the flexible bag 1 to the bottom end 32 of the body member 12.

With reference to FIG. 1, the top edge 24 of the top end 22 of the body member 12 also preferably includes a V-shaped portion 38 positioned towards the front 40 of the body member 12. The V-shaped portion 38 helps scooping of material into the body member hollow interior 20 and also permits easy pouring of material with a shovel from the front 40 of the body member 12 through the body member hollow interior 20 into the interior of a flexible bag 1.

Even more preferably, the perimeter wall 14 has a pair of arcuate portions 42,44 that converge together at a cleft 46 positioned towards the front 40 of the body member 12. In this more preferred embodiment of the invention, the lower vertex 48 of the V-shaped portion 38 is positioned at the cleft 46 at the front 40 of the body member 12.

Ideally, the bag filling device 10 also includes a pair of spaced apart handles 50,52 extending from the outer surface 18 of the perimeter wall 1. The handles 50,52 are designed for aiding scooping of material through body member hollow interior 20.

In use, the bag filling device 10 may be used to quickly fill, especially in emergency situations, a flexible bag 1 with a scoopable material such as sand, gravel, and dirt. Illustratively, the bottom end 32 of the body member 12 is inserted through the opening 2 into the interior of the flexible bag 1 such that the opening 2 of a flexible bag 1 can be extended along the outer surface 18 of the perimeter wall 14 towards the top end 22 of the body member 12. This helps hold the flexible bag 1 to the bottom end 32 of the body member 12. A user may then grasp the handles 50,52 so that the scooping portion 28 of the top end 22 of the body member 12 is tilted towards the scoopable material. This permits a user to scoop the scoopable material with the scooping portion 28 of the top edge 24 of the body member 12 through the upper opening 26 into the body member hollow interior 20. Preferably, when a user grasps the handles 50,52, the user also grasps a portion of the flexible bag 1 to help hold the bag 1 to the bag filling device 10. In this preferred method, it is even more preferable that the flexible bag 1 be pulled over the outer surface 18 to cover the handles 50,52 so that a user grasping the handles 50,52 grasps the bag 1 at the same time. Next, the bottom end 32 of the body member 12 may be tilted downwards so that the scoopable material is passed through the lower opening 36 into the interior of the flexible bag 1.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bag filling device for filling a flexible bag having an opening into its interior, said bag filling device comprising:

an elongate tubular body member being formed by a perimeter wall, said body member having top and bottom ends, a front, and a back;

said perimeter wall having inner and outer surfaces, said inner surface defining a body member hollow interior;

said top end of said body member having a top edge, said top edge defining an upper opening into said hollow interior, said top edge having a scooping portion;

said scooping portion of said top edge being positioned towards the back of said body member, said scooping portion being for permitting the scooping of material through said upper opening into said body member hollow interior;

said bottom end of said body member having a bottom edge, said bottom edge defining a lower opening into said body member hollow interior, said bottom end of said body member being for insertion through the opening of a flexible bag into the interior of a flexible bag to permit passage of material through said body member hollow interior into the interior of a flexible bag;

wherein said top edge of said top end of said body member has a V-shaped portion being positioned towards said front of said body member; and wherein said perimeter wall has a pair of arcuate portions converging together at a cleft, said cleft being positioned towards said front of said body member.

2. The bag filling device of claim 1, wherein said body member is tapered towards said bottom end.

3. The bag filling device of claim 1, wherein said V-shaped portion of said top edge has a lower vertex, said lower vertex of said V-shaped portion being positioned at said cleft.

4. The bag filling device of claim 1, further comprising a pair of spaced apart handles being extended from said outer surface of said perimeter wall, said handles being for aiding scooping of material through body member hollow interior.

5. A bag filling device for filling a flexible bag having an opening into its interior, said bag filling device comprising:

an elongate tubular body member being formed by a perimeter wall, said body member having top and bottom ends, a front, and a back;

said body member being tapered towards said bottom end;

said perimeter wall having inner and outer surfaces, said inner surface defining a body member hollow interior;

said perimeter wall having a pair of arcuate portions converging together at a cleft, said cleft being positioned towards said front of said body member;

said top end of said body member having a top edge, said top edge defining an upper opening into said hollow interior, said top edge having a scooping portion and a V-shaped portion;

said scooping portion of said top edge being positioned towards the back of said body member, said scooping portion being for permitting the scooping of material through said upper opening into said body member hollow interior;

said V-shaped portion of said top edge being positioned towards said front of said body member, said V-shaped portion of said top edge having a lower vertex, said lower vertex of said V-shaped portion being positioned at said cleft;

said bottom end of said body member having a bottom edge, said bottom edge defining a lower opening into said body member hollow interior, said bottom end of said body member being for insertion through the opening of a flexible bag into the interior of a flexible bag to permit passage of material through said body member hollow interior into the interior of a flexible bag; and a pair of spaced apart handles being extended from said outer surface of said perimeter wall, said handles being for aiding scooping of material through body member hollow interior.

6. A method for filling a flexible bag with a scoopable material, comprising the steps of:

providing a flexible bag having an opening into its interior;

providing a bag filling device comprising:

an elongate tubular body member being formed by a perimeter wall, said body member having top and bottom ends, a front, and a back;

said body member being tapered towards said bottom end;

said perimeter wall having inner and outer surfaces, said inner surface defining a body member hollow interior;

said perimeter wall having a pair of arcuate portions converging together at a cleft, said cleft being positioned towards said front of said body member;

said top end of said body member having a top edge, said top edge defining an upper opening into said hollow interior, said top edge having a scooping portion and a V-shaped portion;

said scooping portion of said top edge being positioned towards the back of said body member, said scooping portion being for permitting the scooping of material through said upper opening into said body member hollow interior;

said V-shaped portion of said top edge being positioned towards said front of said body member, said V-shaped portion of said top edge having a lower vertex, said lower vertex of said V-shaped portion being positioned at said cleft;

said bottom end of said body member having a bottom edge, said bottom edge defining a lower opening into said body member hollow interior, said bottom end of said body member being for insertion through the opening of a flexible bag into the interior of a flexible bag to permit passage of material through said body member hollow interior into the interior of a flexible bag;

a pair of spaced apart handles being extended from said outer surface of said perimeter wall, said handles being for aiding scooping of material through body member hollow interior;

inserting said bottom end of said body member through said opening of said flexible bag into said interior of said flexible bag;

grasping said handles;

titling said scooping portion of said top end of said body member towards said scoopable material;

scooping said scoopable material with said scooping portion of said top edge of said body member through said upper opening of said body member into said body member hollow interior;

tilting said bottom end of said body member downwards; and passing said scoopable material through said lower opening into said interior of said flexible bag.

* * * * *